US005646367A

United States Patent [19]

Shanks et al.

[11] Patent Number: 5,646,367

[45] Date of Patent: Jul. 8, 1997

[54] CONDUCTIVE PRIMER MIX

[75] Inventors: Robert B. Shanks; Frances G. Lopata; Kevin N. Graves, all of Little Rock, Ark.

[73] Assignee: Remington Arms Company, Inc., Madison, N.C.

[21] Appl. No.: 609,294

[22] Filed: Mar. 1, 1996

[51] Int. Cl.[6] ..... C06B 41/02

[52] U.S. Cl. ..... 149/24; 149/28

[58] Field of Search ..... 149/24, 27, 28

[56] References Cited

U.S. PATENT DOCUMENTS

| | | | |
|---|---|---|---|
| 1,971,030 | 8/1934 | Brün | 149/28 |
| 2,163,498 | 6/1939 | Scholz | 149/28 |
| 2,341,205 | 2/1944 | Brün | 149/28 |
| 2,480,141 | 8/1949 | King | 149/28 |
| 3,090,310 | 5/1963 | Peet et al. . | |
| 3,320,104 | 5/1967 | Stadler . | |
| 3,423,259 | 1/1969 | Staba | 149/28 |
| 3,719,148 | 3/1973 | Gawlick et al. . | |
| 3,989,683 | 11/1976 | Staba | 149/28 |
| 4,029,530 | 6/1977 | Kenney | 149/28 |
| 4,133,707 | 1/1979 | Andrew | 149/28 |
| 4,386,567 | 6/1983 | Ciccone et al. . | |
| 4,994,125 | 2/1991 | Mei . | |

*Primary Examiner*—Edward A. Miller
*Attorney, Agent, or Firm*—Huntley & Associates

[57] ABSTRACT

Electrically ignitable conductive primer mixture comprising aluminum and carbon black and having reduced tetrazene, the mixture also containing lead styphnate, antimony sulfide and barium nitrate.

5 Claims, No Drawings

CONDUCTIVE PRIMER MIX

BACKGROUND OF THE INVENTION

Ammunition for small arms is typically actuated with the aid of a primer, which initiates the principle charge in the cartridge. Typically, these primers have been initiated by the impact of a firing pin. With the increasing use of electronic firing systems, development has been directed to priming mixtures that are suitable for use in small arms, and provide the desired combination of reliable initiation and insensitivity to stray electrical charges. Typically, electrically ignitable primers have been initiated by exploding bridge wires or hot wires in combination with a semi-conductive mixture, a pyrotechnic mix or conductive mix. Such electrically ignitable primers have been previously used in military applications for high speed firing of large caliber ordnance, in blasting for mining operations, for automotive crash bag initiation and inflation, seismic guns, kiln guns and pyrotechnic displays. However, a continuing need exists for a simple and reliable priming system that would be suitable for small arms such as rifles, pistols and shotguns.

SUMMARY OF THE INVENTION

The present invention provides an electrically ignitable primer mixture which is suitable for use in small arms munition and provides a desirable combination of safety and reliable initiation.

Specifically, the instant invention provides an electrically ignitable primer mixture comprising about from 30 to 40% lead styphnate; about from 4 to 12% antimony sulfide; up to about 5% tetrazene; about from 40 to 55% barium nitrate; about from 4 to 8% aluminum; about from 0.5 to 2% carbon black and up to 1% binder.

DETAILED DESCRIPTION OF THE INVENTION

The present invention is based on the discovery that mixtures of the indicated components, in the specified quantities, are insensitive to low voltage initiation but at higher voltages provide reliable initiation of the lead styphnate which is a principal explosive component of the mixtures.

Lead styphnate should be present in a quantity of at least about 30% by weight of the formulation. In general, little additional benefit is gained by the incorporation of more than about 40% lead styphnate.

Antimony sulfide is used in the present formulations as a fuel. It is used to tailor the desired shock or detonation velocity, detonation pressure and output temperature. In general, at least about 4% of this component should be present, while greater than about 12% provides little additional benefit to the present formulations.

With the present primer mixtures, tetrazene, normally used in primer mixtures, can be substantially eliminated. This compound is also known as tetracene, tetrazolyl, guanyltetrazene hydrate or tetrazene-1-carboxamidine-4-(1-H-tetrazol-5-yl)monohydrate. In general, less than about 5% of this component is present in the present formulations. Less than about 2% is preferred, and the substantial absence of tetrazene is especially preferred.

Barium nitrate is present in the present formulations in a concentration of about from 40 to 55%. The function of the barium nitrate is as an oxidizer. The primer mix will generally not properly ignite at concentrations of less than about 40% by weight, while concentrations of the barium nitrate greater than about 55 weight percent will not exhibit satisfactory explosive propagation.

The present invention is based on the discovery that aluminum can effectively provide a secondary electrical path that assists in the prevention of low voltage initiation. The aluminum should be present in quantities of about from 4 to 8%. The aluminum used is typically in fine particulate form, having a particle size of about from 5 to 40 micrometers. This particle size passes a 325 mesh sieve.

The present formulations contain about from 0.5 to 2% carbon black. The presence of carbon black, together with the aluminum, aids in providing secondary electrical paths to prevent or minimize low voltage initiation. A wide variety of carbon blacks can be used in the present invention. Carbon blacks are crystallographically related to semiconductors. They are usually described and categorized by their method of manufacture. For example, lamp black is the soot formed in the glass chimney of a lamp, while acetylene black is formed by oxygen deficient reduction of acetylene. Each method of manufacture gives somewhat different crystalline structure to the carbon black. Different structures are useful for specific applications. A carbon black used for pigment should have good light reflection characteristics, while a carbon black used for absorption matrix should have many small pores. An electrically conductive carbon black also requires special characteristics, such as particle size and volatile content. A higher degree of electrical conductivity is achieved with higher surface area, higher structure, and lower volatile content. Higher surface area is attained by forming a particle with many pores, and higher structure means that the carbon particles are aggregated to a significant extent. A lower volatile content results in fewer chemisorbed oxygen complexes on the surface of the particles. This chemisorbed oxygen can act as an insulator making the carbon black less conductive. A volatile content of less than about 5%, and especially less than about 2%, is preferred.

The degree to which the carbon black is electrically conductive also depends on the network formed by the carbon atom aggregates in their surrounding matrix. The electron path flow is facilitated by aggregate contact and small separation distances between aggregates. The more contact between aggregates, the closer the aggregates are, the better the electron flow. Furnace black is preferred in the present invention. Acetylene blacks used in large caliber military electric primers generally lack the electrical characteristics required by small arms firing systems. Pigment carbon blacks typically lack the conductivity required for small arm primers. The particle size of the carbon black is preferably about from 10 to 30 nanometers. The surface area of a carbon black is typically measured as nitrogen surface area, according to ASTM-D-3037. Nitrogen surface areas of greater than about 1000 $m^2/g$ have been found to be satisfactory. A particularly preferred carbon black is that having a nitrogen surface area of about 1475 $m^2/g$.

The primer composition of the present invention can further contain up to about 1% binder to minimize dusting. Typically, at least about 0.5% by weight is used. Binders which can be used can be selected from a variety of gums, such as gum arabics, and particularly gum arabic (acacia), as well as polyvinyl alcohol with guar gum. However, gum arabic has been found to be particularly satisfactory. The particular binder used will be selected for maximum compatibility with the explosive formulation prepared.

The indicated components can be combined by the use of standard low shear mixers, using customary techniques for blending explosives. With these techniques, the explosive components are generally blended first, followed by the fuels, and finally the oxidizer components.

The primer mixtures of the present invention generally initiate at a direct current of 100 volts or less. The mixtures exhibit reduced impact sensitivity compared to normal primer mixtures, primarily resulting from the reduction or elimination of tetrazene from the mixture. The present invention is further illustrated by the following specific examples, in which parts and percentages are by weight unless otherwise indicated.

EXAMPLES 1–4 AND COMPARATIVE EXAMPLE A

Primer mixtures were formulated from the components and in the quantities indicated in Table I. These formulations were evaluated using a computer data base to determine the characteristics for optimum initiations of propellant, approximating a standard percussion priming mixture. The results are summarized in the table, together with parallel calculations for Comparative Example A, which is a lead styplmate primer mix currently used in the commercial production of percussion primers.

TABLE I

| Example Mixtures | 1 | 2 | 3 | 4 | A |
|---|---|---|---|---|---|
| Lead Styphnate | 35 | 33 | 36 | 36 | 35 |
| Antimony Sulfide | 13 | 13 | 8 | 5 | 12 |
| Tetrazene | 0 | 0 | 0 | 0 | 5 |
| Barium Nitrate | 44 | 46 | 50 | 52.3 | 41 |
| Aluminum | 7 | 7 | 5 | 1.2 | 0 |
| Carbon Black | 1 | 1 | 1 | 1.2 | 0 |
| Gum Binder | 0.5 | 0.5 | 0.5 | 0.5 | 0.5 |
| Calculated Values For: | | | | | Lead Styphnate Mix (in production) |
| Shock Velocity (m/s) | 5,002 | 5,043 | 5,303 | 5,362 | 5,362 |
| Detonation Pressure (atm) | 148,800 | 149,360 | 163,560 | 163,980 | 173,300 |
| Reaction Temperature (K) | 2,806 | 2,812 | 2,655 | 2,816 | 2,995 |
| Reaction Enthalpy (cal/g) | 1,066 | 1,070 | 1,187 | 1,202 | 1,256 |
| Reaction Entropy (cal/g) | 117 | 116 | 129 | 129 | 142 |

The primer mix of Example 4 was tested ballistically in two metal primer cartridges. In the design used in Example 4A, the conduction path was from a conductive center post through the mix and into the side wall of the primer cup, which was attached to ground. In the second design, used in Example 4B, the conduction path was from the primer cup through the mix and into an annular post which was attached to ground. The ballistic results of firing this mix are as follows:

| Loaded in 22–250 REM 55 gr PSP | 4A | 4B | |
|---|---|---|---|
| Velocity, ambient (fps) | 3,564 | 3,599 | Spec: 3,650 fps+/–35 |
| Pressure, ambient (psi) | 57,400 | 58,300 | Spec: 60,000 psi maximum |

We claim:

1. An electrically ignitable small arms primer mixture comprising about from 30 to 40% lead styphnate; about from 4 to 12% antimony sulfide; about from 40 to 55% barium nitrate; about from 4 to 8% aluminum; about from 0.5 to 2% carbon black and up to about 1% binder, and wherein the mixture is substantially free from tetrazene.

2. A primer mixture of claim 1 containing at least about 1% carbon black.

3. A primer mixture of claim 1 wherein the carbon black consists essentially of furnace black.

4. A primer mixture of claim 1 comprising at least about 0.5% binder.

5. A primer mixture of claim 4 wherein the binder consists essentially of gum arabic.

* * * * *